United States Patent [19]

Brown et al.

[11] 4,073,305

[45] Feb. 14, 1978

[54] SIPHON PUMP

[75] Inventors: Amos J. Brown, Alderwood Manor; Thomas E. Belshaw, Seattle; Kenneth L. Knull, Sumner; Wilbur D. Wilke, Camano Island, all of Wash.

[73] Assignee: Belshaw Brothers, Inc., Seattle, Wash.

[21] Appl. No.: 688,175

[22] Filed: May 20, 1976

[51] Int. Cl.[2] ..... F04F 10/02

[52] U.S. Cl. ..... 137/140; 137/150; 137/152

[58] Field of Search ..... 137/140, 147, 148, 150, 137/152; 222/204, 416

[56] References Cited

U.S. PATENT DOCUMENTS

| | | | |
|---|---|---|---|
| 628,088 | 7/1899 | Giles | 137/140 X |
| 1,195,864 | 8/1916 | Starr | 137/150 X |
| 1,584,550 | 5/1926 | Kellog | 137/140 |

FOREIGN PATENT DOCUMENTS

| | | | |
|---|---|---|---|
| 1,222,648 | 1/1960 | France | 137/148 |
| 218,868 | 1/1942 | Switzerland | 137/150 |

*Primary Examiner*—Robert G. Nilson
*Attorney, Agent, or Firm*—Seed, Berry, Vernon & Baynham

[57] ABSTRACT

An elongated tube is bent to have a central portion, a short leg and a long leg. The long leg is closed by a cap which is counterbalanced into the closed position. An elongated inner tube having an outer upper end passes through the sidewall of the long leg and terminates a substantial distance down in the long leg of the outer tube. The outer end of the inner tube is covered by a conventional bulb air pump. Squeezing the air pump pushes a pulse of air out the lower end and creates a vacuum when the cap is closed to begin siphoning through the short leg.

6 Claims, 1 Drawing Figure

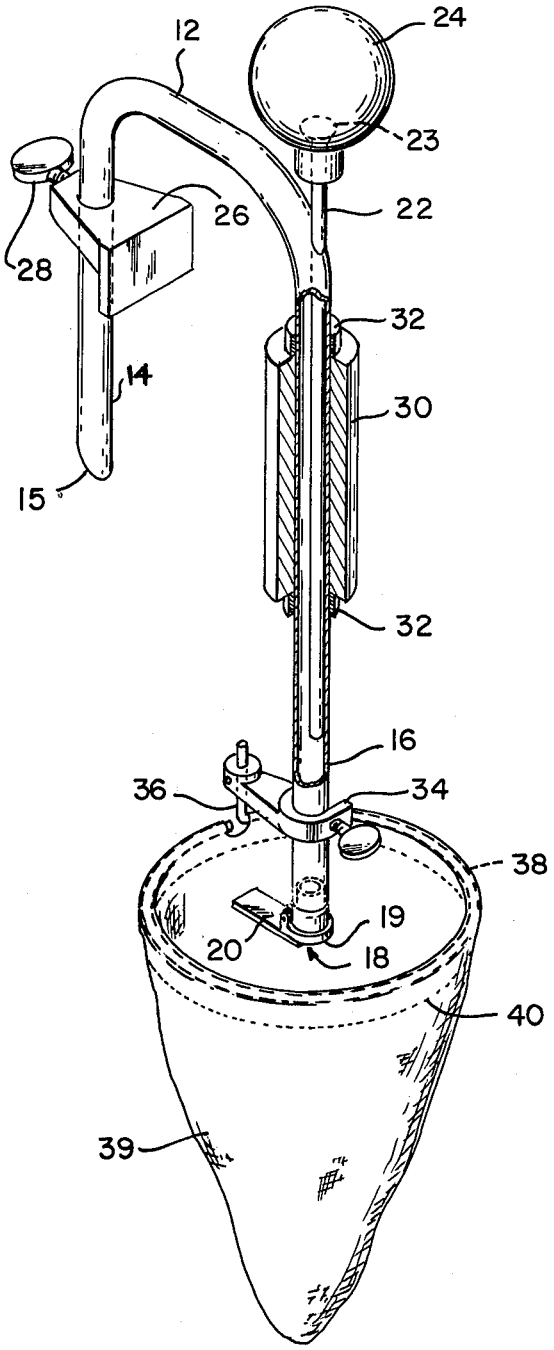
12
24
23
22
26
28
32
14
30
15
32
16
36
34
38
19
20
18
40
39

SIPHON PUMP

BACKGROUND OF THE INVENTION

1. Field of the Invention

This invention pertains to siphon pumps for evacuating liquids and is particularly useful for removing hot fats from frying machines.

2. Description of the Prior Art

Frying liquids, usually vegetable shortening, must be changed periodically. In order to save time, the shortening or fat is generally changed while it is still hot and of relatively low viscosity. Changes can most safely be done by using a siphon pump to drain the tank. One commonly used device for removing the hot fat is a siphon pump of a type which has an elongated pump cylinder joined at an upper end by an upper tube which fits into the tank of fat and a lower tube which discharges downwardly into some form of filtering or collecting mechanism. To initiate a siphon effect, a piston is raised in the pump cylinder and then pushed downwardly beyond the lower tube so that a suction is created on the upper tube. Once the piston passes the lower tube, the suction created by the piston is broken but the flow of fat up through the upper tube continues from the siphon effect. This well known siphon pump, however, is expensive to manufacture and difficult to operate as the fat can congeal around the piston making initial stroking of the piston difficult.

SUMMARY OF THE INVENTION

It is an object of this invention to provide an improved siphon pump for removing hot liquids from frying mechanisms.

It is another object of this invention to provide a siphon pump which is inexpensive to manufacture, easy to maintain, and simple to operate.

These objects are best obtained by providing hollow outer tube means which has a central portion and two downwardly extending legs, one being a short leg and the other being a long leg. The end of the long leg is closed by a cap which is biased into the closed position. A smaller inner tube has an outer end which is covered by a common inexpensive bulb air pump and the inner tube extends through the sidewall of the outer tube means extending downwardly a substantial distance into the long leg. Squeezing of the bulb when the short leg is immersed in the liquid emits a blast of air out through the end of the long leg and when the cap closes and the bulb expands a suction is created in the short leg drawing the liquid up over the central bent portion and down into the long leg. This creates a siphon effect which continues automatically until the fat level falls below the end of the short leg.

The advantages of this siphon pump are that the fat seldom reaches the bulb pumping mechanism and thus reduces maintenance. Secondly, the pump is quite easy to use generally requiring only a single squeeze of the bulb. Finally, the components of the pump are inexpensive to manufacture allowing the pump to be built at a substantially smaller cost than prior art pumps.

BRIEF DESCRIPTION OF THE FIGURES OF THE DRAWING

FIG. 1 is a perspective illustration of the preferred embodiment of the pump with parts broken away for clarity.

DETAILED DESCRIPTION OF THE PREFERRED EMBODIMENTS

The pump includes an elongated hollow outer tube having a bent central portion 12, a short leg 14 terminating in a beveled opening 15, and a long leg 16 terminating in a cap 18. The cap is a generally airtight enclosure having a closing surface 19 pivotally mounted to the leg 16 and has a weighted end 20 to bias the cap into the closed position.

An elongated inner tube 22 having an upper end with a flange 23 extends downwardly into the long leg a substantial distance. The flange 23 is covered by a conventional bulb air pump 24 with the flange restricting upward movement of the bulb. As is readily understood, when the beveled end 15 of the short leg 14 is immersed in liquid, squeezing of the bulb 24 will cause air to be emitted by forcing open the cap 18 but when the bulb begins to expand the cap closes thus creating a suction on the liquid in the short leg drawing the liquid up around the bent portion 12 to start a flow through the long leg 16. This flow continues through siphon action until the liquid level drops below the top of the opening 15. The length of the tube 22 assures that during the initial suction the hot liquid will not travel up to the bulb 24 protecting the bulb against the effects of the heat.

In order to position the short leg 15 on a tank, the pump is provided with a bracket 26 having a thumbscrew 28 for adjusting the bracket along the tube. In addition, a wooden handle or other insulating handle 30 is secured as by collars 32 to the long leg 16 so that the pump can be handled while it is still hot.

A filter bracket 34 is attached to the long leg adjacent the cap 18. The filter bracket supports a rod 36 that is formed in an open horizontal loop 38. A filter bag 39 is sewn to have a seam 40 which forms a closed channel that is slid over the rod 38 and thus the bag is centrally positioned around the lower end of the long leg 16. The bag is thus easily removable for cleaning or replacement.

While the preferred embodiment of the invention has been illustrated and described, it should be understood that variations will be apparent to one skilled in the art without departing from the principles described herein. Furthermore, while the pump is specially suited for siphoning hot liquids, it is readily apparent that the basic principles are applicable to siphoning unheated liquids such as for draining solvent from automotive parts cleaning tanks.

The embodiments of the invention in which a particular property or privilege is claimed are defined as follows:

1. A siphon pump for removing liquids from a tank comprising:

elongated hollow outer tube means having a first end and a lower second end, a cap covering the lower end, means for pressing the cap closed, an elongated hollow inner tube having an outer end outside of said outer tube, extending through said hollow outer tube and terminating upwardly from said lower second end, and a bulb air pump enclosing said outer end of said inner tube and so adapted that squeezing said air pump blows a pulse of air out said lower end of said outer tube means and upon closing of the lower end by the cap creates a vacuum within the outer hollow tube means to suck the liquids into the first end of the outer tube means to begin a siphoning effect, said outer tube means including a single tube having a bent central portion, a short leg terminating at said first end and a longer leg terminating at said second end, said inner tube entering the outer tube at the upper end of the longer leg and extending downwardly at least as far as the first end of the shorter leg whereby the liquid is unlikely to reach the bulb air pump during suction.

2. The pump of claim 1, including bracket means adjustably mounted on said shorter leg for holding the pump on a tank.

3. The pump of claim 1, including an insulated handle on said longer leg for manually holding the pump.

4. The pump of claim 1, said first end of said short leg terminating in an upwardly inclined bevel to provide a vertical opening which will resist clogging.

5. The pump of claim 4, including bracket means adjustably mounted on said shorter leg for holding the pump on a tank, and an insulated handle on said long leg for manually holding the pump.

6. The pump of claim 5, including a filter bracket secured to a lower end of said long leg, rod means secured to said bracket and having an open generally horizontal loop, and a filter bag secured to said loop adapted to filter the liquid passing out of said second end of said outer tube.

* * * * *